US007628521B1

(12) United States Patent
Hsieh

(10) Patent No.: US 7,628,521 B1
(45) Date of Patent: Dec. 8, 2009

(54) HID BULB FIXING APPARATUS

(75) Inventor: Chen-Han Hsieh, Tainan (TW)

(73) Assignee: TYC Brother Industrial Co., Ltd., Tainan (TW)

( * ) Notice: Subject to any disclaimer, the term of this patent is extended or adjusted under 35 U.S.C. 154(b) by 0 days.

(21) Appl. No.: 12/354,160

(22) Filed: Jan. 15, 2009

(51) Int. Cl.
*F21V 19/00* (2006.01)

(52) U.S. Cl. ..... 362/519; 362/549; 362/548; 362/263; 362/645

(58) Field of Classification Search ..... 362/519, 362/549, 548, 640, 645, 263, 448
See application file for complete search history.

(56) References Cited

U.S. PATENT DOCUMENTS 4,614,997 A * 9/1986 Montet ..... 362/549
6,893,149 B2 * 5/2005 Mock et al. ..... 362/519
2001/0030877 A1 * 10/2001 Billot ..... 362/548
2006/0152940 A1 * 7/2006 Josquin et al. ..... 362/509
2007/0139945 A1 * 6/2007 Maliar et al. ..... 362/509

* cited by examiner

*Primary Examiner*—Laura Tso
(74) *Attorney, Agent, or Firm*—WPAT, P.C.; Anthony King

(57) ABSTRACT

A high intensity discharge (HID) bulb fixing apparatus assembles an HID bulb securely in a reflector. The HID bulb includes a circular mounting ring. The HID bulb fixing apparatus includes a base disposed at a rear end of the reflector, and a catch base detachably assembled on the base. The base includes a basal wall, and a bearing flange projecting from an inner circumferential surface of the basal wall and for bearing the mounting ring. The catch base includes two fixing walls clamping at front and rear sides of the basal wall, and two clamping parts clamping at left and right sides of the basal wall. The fixing wall located at the rear side presses against a rear end surface of the basal wall and a surface of the mounting ring. The HID bulb fixing apparatus is applicable to fixing and mounting HID bulbs of different specifications, such that different bulbs may be mounted in reflectors of the same type.

6 Claims, 7 Drawing Sheets

HID BULB FIXING APPARATUS

BACKGROUND OF THE INVENTION

1. Field of the Invention

The present invention relates to a bulb fixing apparatus, and more particularly, to a fixing apparatus for a high intensity discharge (HID) bulb.

2. Description of the Related Art

In recent years, high intensity discharge (HID) bulbs are more and more popular in car lights. The HID bulbs are assembled inside a reflector of a car light apparatus, and the reflector includes a reflecting part at a front end for reflecting light, and a mounting part connected at a rear end of the reflecting part and for assembling the bulb. In the assembly, a pin of the HID bulb is assembled to and combined with the mounting part. However, the pin types of different specifications of HID bulbs are not the same, and the common HID bulbs on market are in specifications such as D15, DIR, D2S, D2R, D3S, D3R, D4S, and D4R. Among others, the bulb bodies of the D1S, D1R, D3S, and D3R have been assembled with a starter, so their shapes and sizes are different from those of the bulbs of the D2S, D2R, D4S, and D4R specifications which are not assembled with a starter.

In order to fix and mount HID bulbs of different pin patterns, the mounting part of the reflector must be designed in structure according to the HID bulb type to be mounted. Therefore, the reflectors for mounting D1S and D1R bulbs cannot be used for mounting D2S and D2R bulbs, and vice versa. Therefore, the conventional reflectors lack a uniform and standardized design, different reflectors can be only used for mounting bulbs of particular types, and the mounting parts of the reflectors are complicated in structure, resulting in the disadvantage of high manufacturing cost.

SUMMARY OF THE INVENTION

Accordingly, the invention is directed to an HID bulb fixing apparatus, which uses a reflector in uniform specifications, and reduces cost.

The HID bulb fixing apparatus of the invention is used for assembling an HID bulb. The HID bulb includes a main body that can emit light, and a mounting ring connected at a rear end of the main body. The HID bulb fixing apparatus includes a base and a catch base detachably assembled on the base. The base includes a basal wall, the basal wall includes an inner circumferential surface and an outer circumferential surface spaced apart and an end surface connected at a rear side of the inner and the outer circumferential surfaces. The base further includes a bearing flange projecting from the inner circumferential surface of the basal wall and for bearing the mounting ring.

The catch base includes a fixing part and two clamping parts connected to left and right sides of the fixing part and movable inside and outside relative to the fixing part. The fixing part includes a first fixing wall and a second fixing wall clamping separately at front and rear sides of the basal wall. The first fixing wall presses against the end surface of the basal wall and a surface of the mounting ring, and the clamping parts clamp at the left and right sides of the base.

DETAILED DESCRIPTION OF THE INVENTION

The above and other technical contents, features and efficacies of the invention are clearly presented below in the detailed description of an embodiment with reference to the accompanying drawings.

Figure 1:
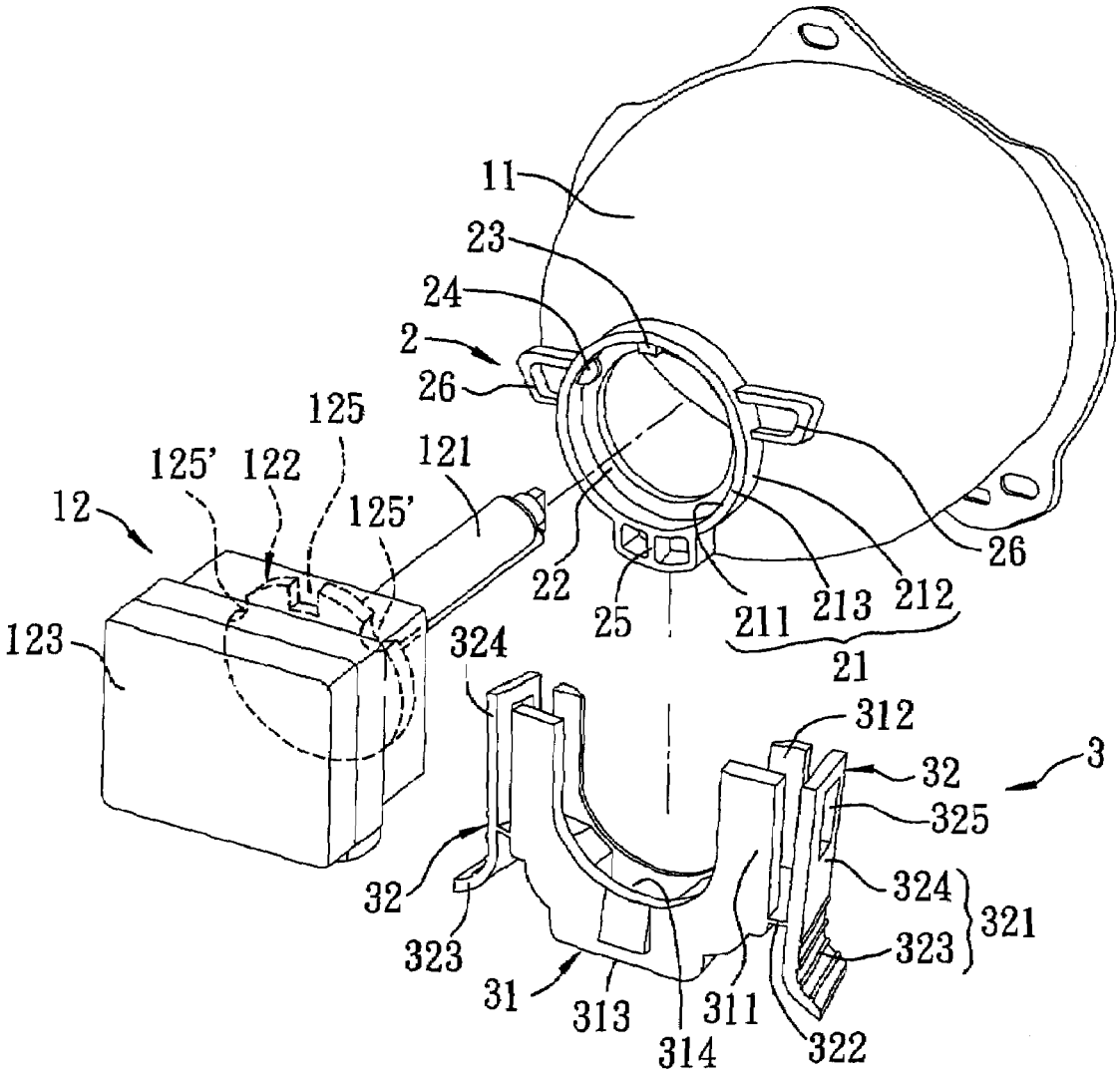
FIG. 1 is a rear three-dimensional exploded view showing the assembling relationship of an HID bulb fixing apparatus according to an embodiment of the invention, a reflector, and a bulb.
Figure 2:
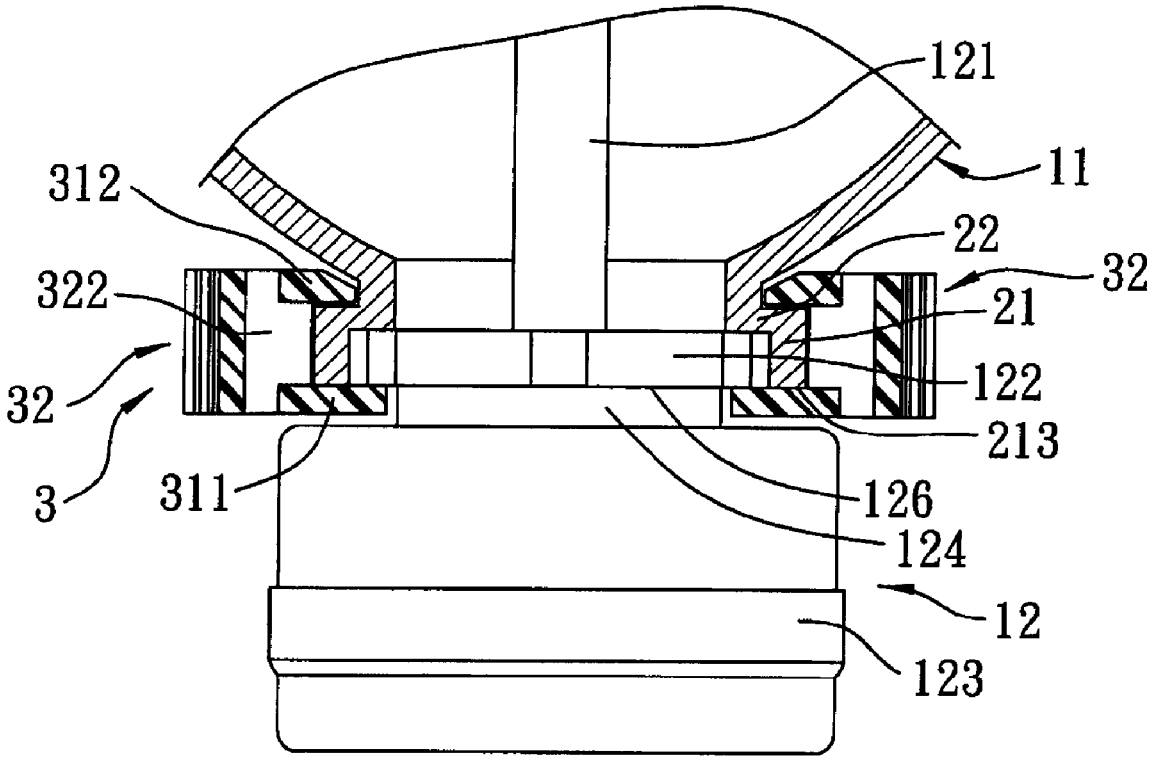
FIG. 2 is a local combined cross-sectional view of the embodiment, the reflector, and the bulb.
Figure 3:
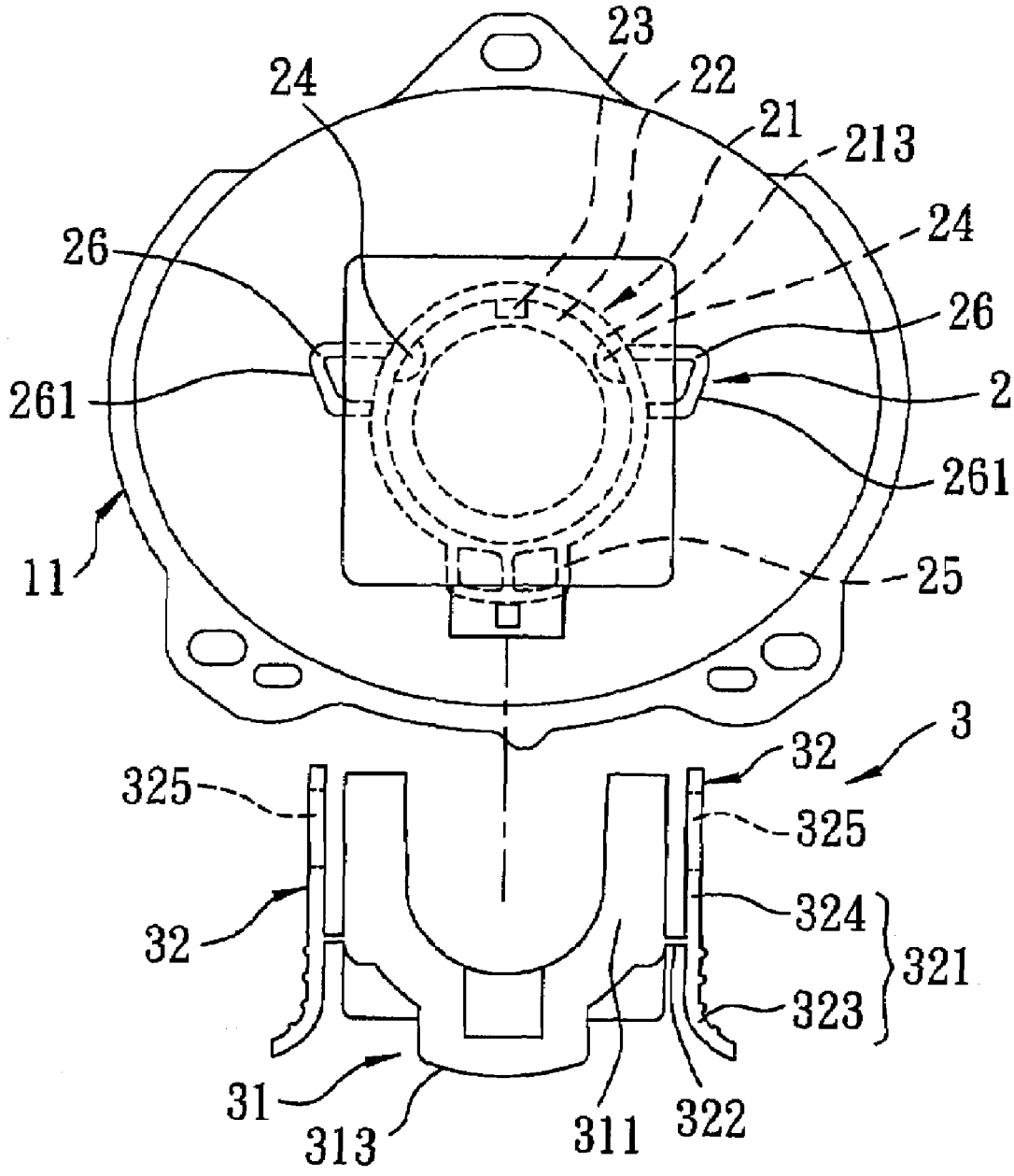
FIG. 3 is a rear exploded view of the embodiment, the reflector, and the lamp.

Referring to FIGS. 1, 2 and 3, an HID bulb fixing apparatus according to an embodiment of the present invention is disposed at a rear end of a reflector 11, and fixes and assembles an HID bulb 12 in the reflector 11. The HID bulb 12 includes a main body 121 extending lengthwise within the reflector 11 and emitting light, a circular mounting ring 122 connected to a rear end of the main body 121, a square starter 123 disposed separately at a rear end of the mounting ring 122, and a radial retracted portion 124 located between the starter 123 and the mounting ring 122 and retracting radially. The mounting ring 122 has a positioning slot 125 located at a center of the mounting ring 122 and depressed radially, two fool-proof grooves 125' located separately at both sides of the positioning slot 125, and a rear surface 126 connecting the radial retracted portion 124 and facing the starter 123. A specific example of the HID bulb 12 is a bulb of the D1S specification. The HID bulb fixing apparatus comprises a base 2 integrally formed at the rear end of the reflector 11, and a catch base 3 detachably mounted at a rear end of the base 2.

The base 2 includes a circular basal wall 21 around a central axis. The basal wall 21 includes an inner circumferential surface 211 and an outer circumferential surface 212 spaced apart, and an end surface 213 connected to rear sides of the inner and the outer circumferential surfaces 211 and 212. The base 2 further includes an annular bearing flange 22 projecting inward from the inner circumferential surface 211, a positioning block 23 protruding backward from a surface of the bearing flange 22, two fool-proof bumps 24 protruding from the surface of the bearing flange 22 and located separately at the left and right sides of the positioning block 23, a lug 25 protruding downward from the outer circumferential surface 212 of the basal wall 21, and two catch wings 26 protruding leftward and rightward respectively from the outer circumferential surface 212 of the basal wall 21. Each of the catch wings 26 has a tapered surface 261 toward outside and inclining inward gradually from top to bottom.

The catch base 3 includes a fixing part 31 at a center of the catch base 3, and two clamping parts 32 that may be wrenched relative to the fixing part 31. The fixing part 31 includes a first fixing wall 311 and a second fixing wall 312 spaced vertically and approximately in the shape of U, and an end wall 313 connected at bottom ends of the first and the second fixing walls 311 and 312. An area of the first fixing wall 311 is greater than that of the second fixing wall 312, and the fixing walls 311, 312 and the end wall 313 define a lug rabbet 314 at the bottom. The lug rabbet 314 is corresponding to the lug 25, and is used for the lug 25 to insert and position therein.

The clamping parts 32 are connected to the left side and the right side of the fixing part 31 respectively, and both include a clamping wall 321 spaced apart from the fixing part 31 and a connecting support wall 322 connecting the clamping walls 321 with the first and the second fixing walls 311, 312. Each of the clamping walls 321 includes a wrenching segment 323 in the lower part and a catching segment 324 in the upper part. The catching segment 324 has an engaging slot 325 corresponding to the catch wing 26 at the same side. Because the clamping wall 321 is made of an elastic plastic material, by wrenching the wrenching segments 323 in the left side and right side in opposite directions, the catching segments 324 on both sides are driven away from each other with the connecting support wall 322 as a supporting point, thereby expanding the space between the clamping parts 32 on the left side and right side and the fixing part 31.

When the invention is assembled with the HID bulb 12, the main body 121 of the HID bulb 12 is first inserted toward the reflector 11 from the rear end to extend into the interior of the reflector 11. The mounting ring 122 urges the surface of the bearing flange 22, and the positioning slot 125 and the fool-proof grooves 125' of the mounting ring 122 are engaged respectively with the positioning block 23 and the fool-proof bumps 24, so that the mounting ring 122 does not rotate relative to the base 2 after the assembly. Because the base 2 is designed for the HID bulb 12, an outer torus of the mounting ring 122 integrates closely with an inner torus of the basal wall 21 as shown in FIG. 2, and the rear surface 126 of the mounting ring 122 is aligned with the end surface 213 of the basal wall 21.

Figure 4:
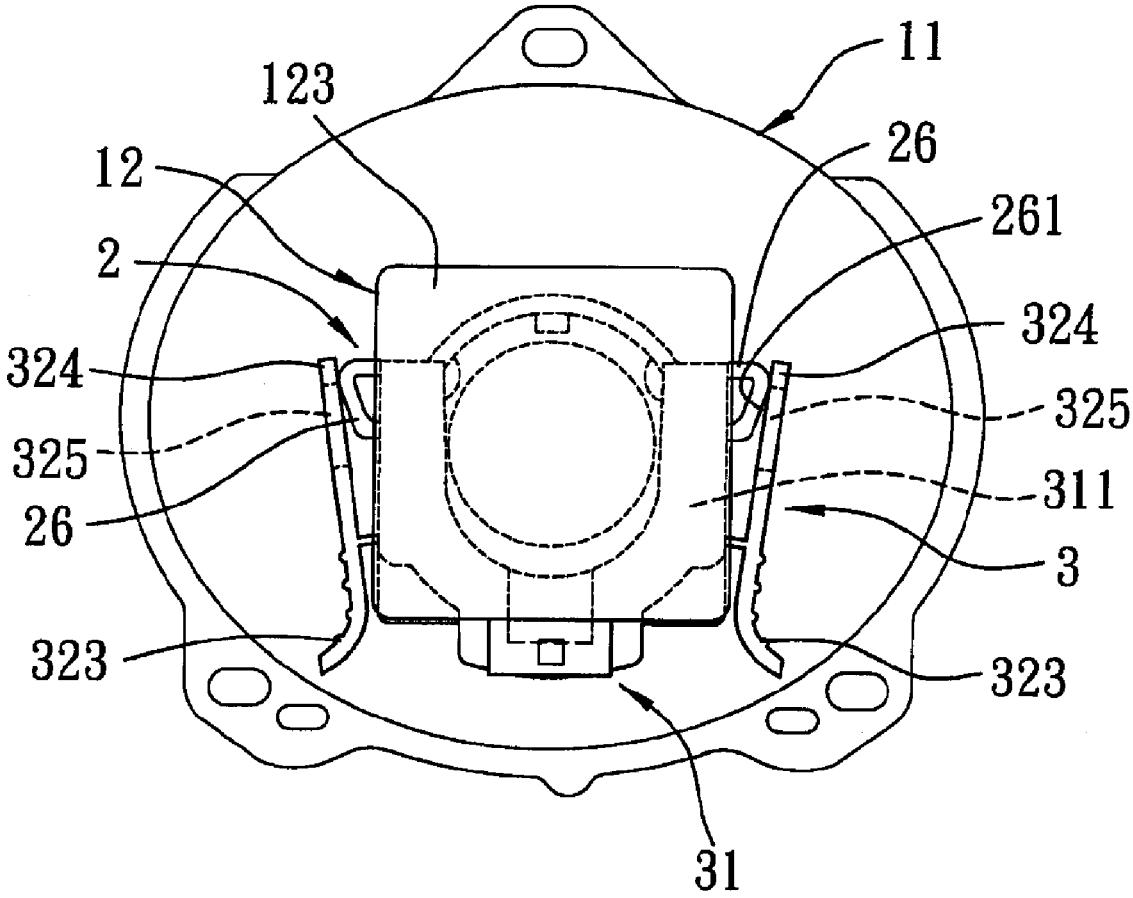
FIG. 4 is a rear view showing a state of a catch base according to the embodiment in an assembling process.
Figure 5:
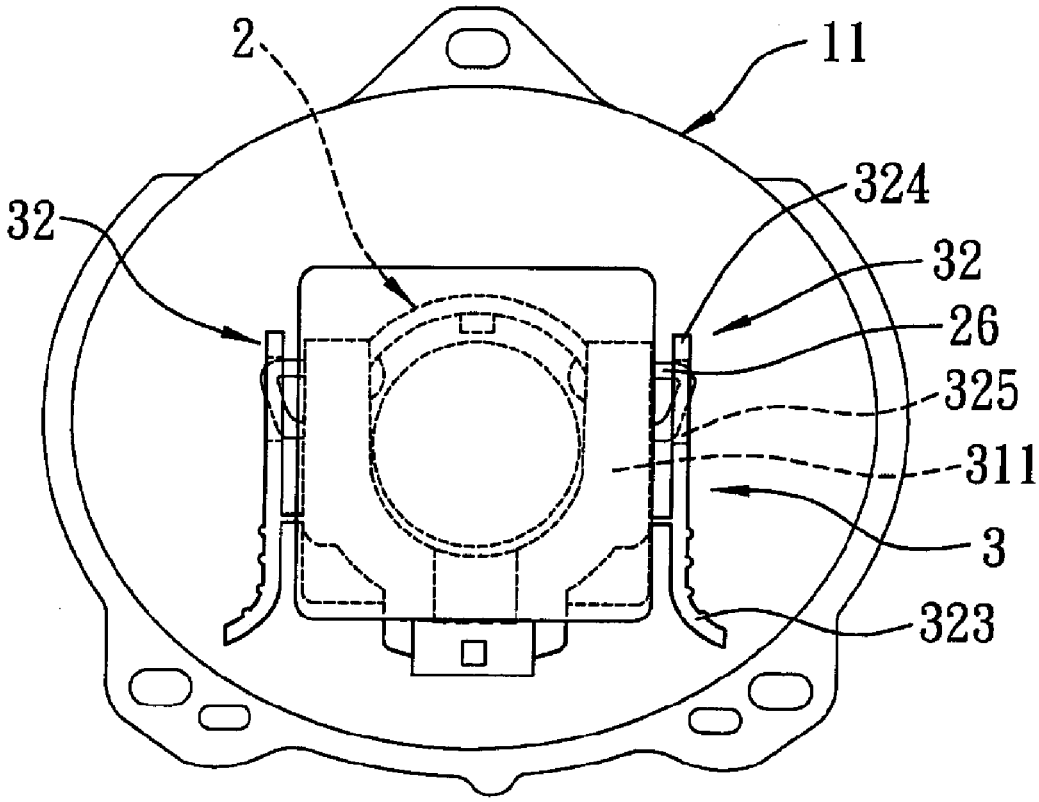
FIG. 5 is a combined rear view of the embodiment, the reflector and the bulb after they are combined.

Referring to FIGS. 2, 4, and 5, the catch base 3 is then pushed toward the base 2 and the HID bulb 12, and is clamped. During the pushing mounting of the catch base 3, the catching segments 324 on both sides are pushed downward by the slanting tapered surface 261 to spread outwards gradually (as shown in FIG. 4). Finally, the catch wings 26 extend into the engaging slots 325 through between the first and the second fixing walls 311 and 312, and the catching segments 324 are not pushed against by the tapered surface 261, and recover their original states (as shown in FIG. 5). At this time, the first and the second fixing walls 311 and 312 are clamped respectively at the front side and the rear side of the basal wall 21, and the first fixing wall 311 extends to around the radial retracted portion 124 and presses against the end surface 213 of the basal wall 21 and the rear surface 126 of the mounting ring 122. The clamping part 32 clamps at the left and right sides of the base 2, and fixes and mounts the bulb 12 to the base 2. To detach the catch base 3, the wrenching segments 323 in both sides are wrenched in opposite directions, such that the catching segments 324 in both sides are away from each other (as shown in FIG. 4) so as to relieve the engagement between the catch wings 26 and the engaging slot 325. At this time, the catch base 3 may be pulled downward to be detached from the base 2 and the reflector 11.

It should be noted that, when the catch base 3 is assembled, the wrenching segments 323 in both sides may also be wrenched first in opposite directions, such that the catching segments 324 in both sides are away from each other. Then, the catch base 3 is sleeved onto the base 2, and relieve the force applied to the wrenching segments 323 when the catch wings 26 are at positions corresponding to the engaging slots 325, so that the catching segments 324 approach each other and engage with the base 2. Through this assembly mode, the catching segments 324 can spread without being pushed by the tapered surface 261, so the tapered surface 261 is not a necessary part in the invention. Moreover, in order to facilitate the assembly, the front side of the reflector 11 can also be placed downward. At this time, the bulb 12 is inserted into the reflector 11 from top to bottom, and the catch base 3 is pushed in or detached in a front-rear direction.

Referring to FIGS. 1 and 2, it is known from the previous description that, the catch base 3 is securely assembled with the base 2 through the fitting of the lug rabbet 314 and the engaging slots 325 with the lug 25 and the catch wings 26 respectively, and the basal wall 21 and the mounting ring 122 are clamped together through the fitting of the first fixing wall 311 with the second fixing wall 312. Thus, the mounting ring 122 will not move arbitrarily, and the bulb 12 can be assembled securely on the reflector 11.

Figure 6:
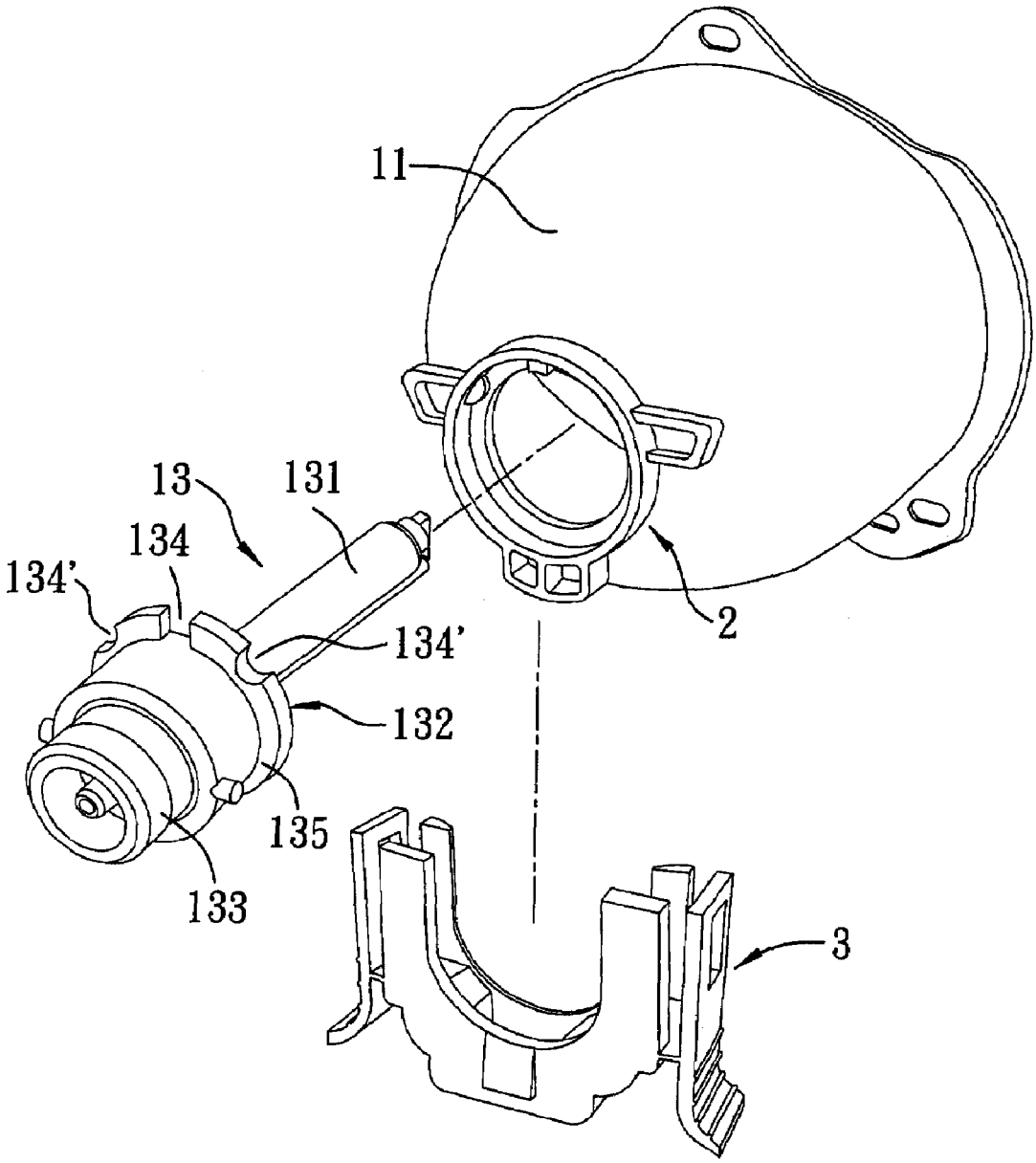
FIG. 6 is a three-dimensional exploded view showing the assembling relationship of the embodiment, the reflector, and a bulb of another type.
Figure 7:
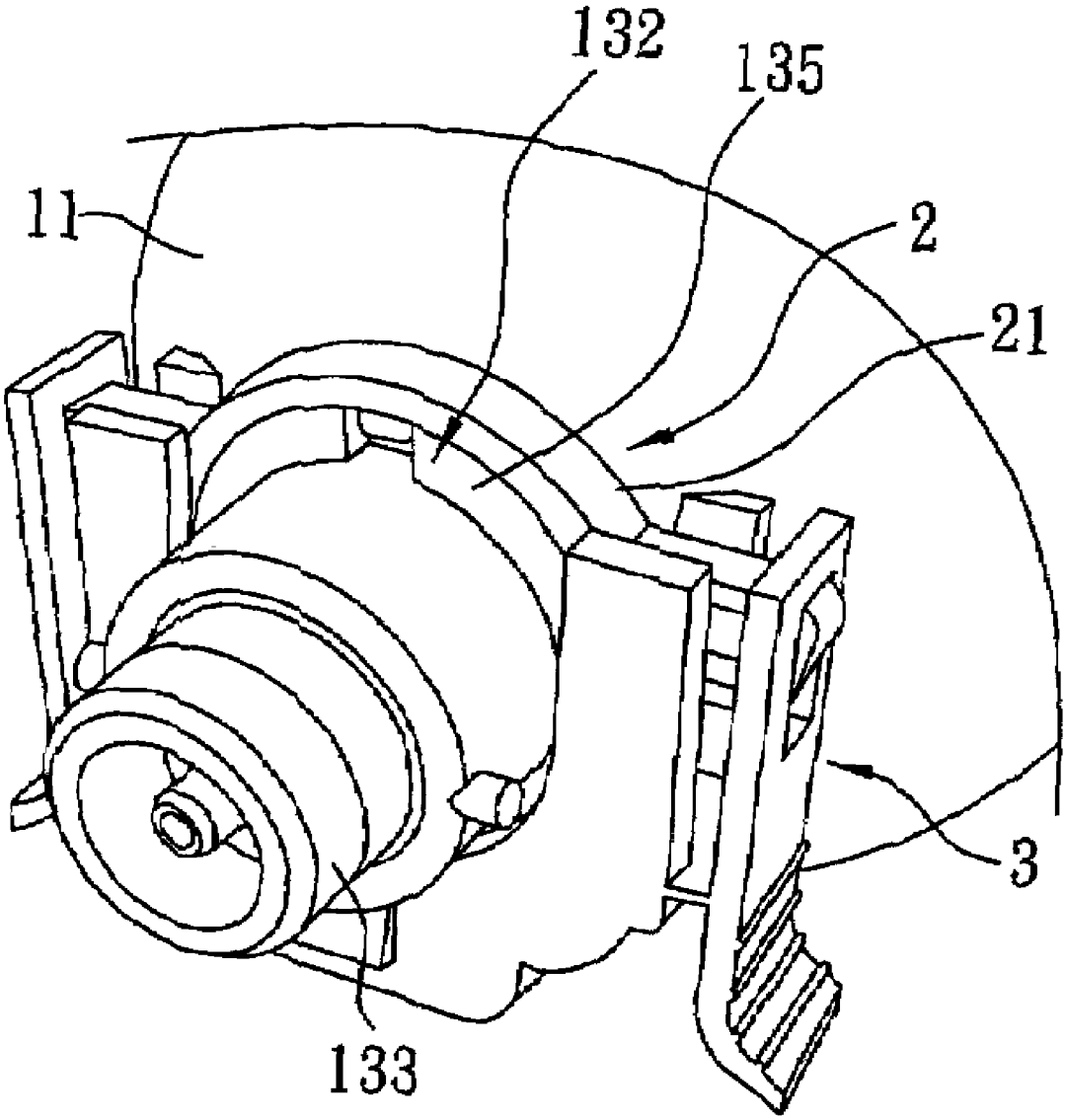
FIG. 7 is a local three-dimensional combined view of the embodiment, the reflector, and the bulb.

Referring to FIGS. 6 and 7, the invention may also be used for assembling HID bulbs 13 of a different type, for example, a bulb of the D2S specification. The lamp 13 includes a main body 131 extending lengthwise, a circular mounting ring 132 connected at a rear end of the main body 131, and an axial protrusion 133 extending backward from the mounting ring 132. Likewise, the mounting ring 132 has a positioning slot 134 depressed radially, two fool-proof grooves 134' spaced apart in left and right, and a rear surface 135. The assembly mode of the invention with the HID bulb 13 is the same as the above description, that is, the bulb 13 may also be clamped by the catch base 3 to be assembled with the base 2 and the reflector 11.

To sum up, the structures of the ends of the bulbs 12, 13 of different types are not the same, but they both have a circular mounting ring 122 or 133. The invention is adapted to assemble the mounting ring 122, 133 by utilizing the circular basal wall 21 of the base 2, and clamp the basal wall 21 and the mounting ring 122 by the first and the second fixing walls 311 and 312, enabling the bulbs 12, 13 to be fixed and assembled on the base 2. Therefore, the invention is applicable to bulbs 12, 13 of different specifications, such that the bulbs 12, 13 of different types to be mounted to the reflector 11 of the same specification. Thus, the manufacturing cost is reduced, and the assembly and detachment of the utility are quite convenient, that is, the objectives of the invention are achieved.

While the embodiments of the present invention have been illustrated and described, various modifications and improvements can be made by those skilled in the art. The embodiments of the present invention are therefore described in an illustrative, but not restrictive, sense. It is intended that the present invention may not be limited to the particular forms as illustrated, and that all modifications which maintain the spirit and scope of the present invention are within the scope as defined in the appended claims.

What is claimed is:

1. A high intensity discharge (HID) bulb fixing apparatus, for assembling an HID bulb, wherein the HID bulb comprises a main body emitting light, and a mounting ring connected at a rear end of the main body, the HID bulb fixing apparatus comprising:

a base, comprising a basal wall, wherein the basal wall comprises an inner circumferential surface, an outer circumferential surface, an end surface and a bearing flange, the inner circumferential surface and the outer circumferential surface spaced apart, the end surface connected to rear sides of the inner and the outer circumferential faces, and the bearing flange projecting from the inner circumferential surface of the basal wall and for bearing the mounting ring; and a catch base, detachably assembled with the base, and comprising a fixing part and two clamping parts connected to left and right sides of the fixing part and movable inside and outside relative to the fixing part, wherein the fixing part comprises a first fixing wall and a second fixing wall clamping separately at front and rear sides of the basal wall, the first fixing wall presses against the end surface of the basal wall and a surface of the mounting ring, and the clamping parts clamp at left and right sides of the base.

2. The HID bulb fixing apparatus according to claim 1, wherein the base further comprises a lug and two catch wings, the lug protruding outward from the outer circumferential surface of the basal wall, the two catch wings spaced apart with each other and protruding from the outer circumferential surface of the basal wall; and the catch base further comprises an end wall connecting the first and the second fixing walls, the first and the second fixing walls and the end wall define a lug rabbet corresponding to the lug, and each of the clamping parts has an engaging slot engaged with the catch wing on a same side.

3. The HID bulb fixing apparatus according to claim 2, wherein each of the clamping parts comprises a clamping wall and a connecting support wall, the clamping wall separated from the fixing part, the connecting support wall connecting securely the clamping walls with the first and the second fixing walls; each of the clamping walls comprises a catching segment movable inside and outside relative to the connecting support, and the engaging slots are disposed in the catching segment.

4. The HID bulb fixing apparatus according to claim 2, wherein each of the catch wings has a tapered surface facing the clamping part of the same side and disposed obliquely, when the catch base is pushed in toward the base, the clamping parts in both sides are pushed by the tapered surfaces and spread outwards gradually, until the catch wings extend into the engaging slots, and the catch wings are not pushed by the tapered surfaces and recover original states.

5. The HID bulb fixing apparatus according to claim 1, wherein the base further comprises a positioning block protruding from a surface of the bearing flange and positioning the mounting ring of the HID bulb.

6. The HID bulb fixing apparatus according to claim 1, wherein after the HID bulb is assembled, the surface of the mounting ring is aligned with the end surface of the basal wall.

* * * * *